US005501126A

United States Patent [19]

Wright

[11] Patent Number: 5,501,126

[45] Date of Patent: Mar. 26, 1996

[54] CROSSING-JAW LOCKING PLIERS

[76] Inventor: Brent P. Wright, 5233 S. State, Murray, Utah 84107

[21] Appl. No.: 283,585

[22] Filed: Aug. 1, 1994

[51] Int. Cl.[6] ..... B25B 7/02

[52] U.S. Cl. ..... 81/418; 81/302

[58] Field of Search ..... 81/302, 367, 368, 81/418, 419

[56] References Cited

U.S. PATENT DOCUMENTS 4,601,221 7/1986 Kalkbrenner et al. ..... 81/418
4,907,477 3/1990 Farber ..... 81/302
5,050,466 9/1991 Cameron ..... 81/419
5,062,191 11/1991 Carr ..... 81/302 X

*Primary Examiner*—James G. Smith

[57] ABSTRACT

Utilization and permanent attachment of elongated, split, novelty shaped jaws onto a pair of conventional quick releasable vise-grip locking pliers. By use of the alternate embodiment of invention, the split crossing jaws enables positive clamping, holding, and spreading of various shaped objects from inside surfaces only, while maintaining conventional applications of locking pliers.

1 Claim, 1 Drawing Sheet

CROSSING-JAW LOCKING PLIERS

BACKGROUND OF THE INVENTION

1. Field of Invention

This invention relates to Quick Releasable Vise-grip pliers, specifically to an improved clamping jaw mechanism.

2. Description of Prior Art

Adjustable, quickly releasable, locking pliers employed by operators skilled in the art typically have short jaws which limit their range of general use. Their range of motion in gripping materials of increasing size is limited, therefore impeding many applications. Furthermore, the ends of the jaws in quick releasable pliers must approach each other, end to end, in order to hold materials.

The purpose of employing vise-grip type pliers is that they are adjustable to and readily releasable from their work pieces. Actuating levers, locking, and quick releasable mechanisms are shown in U.S. Pat. No. 2,280,005 by William Petersen, 1924.

Other inventions have fashioned jaw arrangements of the C-clamp type for self-locking plier clamps, short jaws with a nearly flat parallel inside jaw and teeth shape. Some jaws have a concave inside jaw shape, needle-nose shape, a bent needle-nose shape, also half C-clamp ends applied to holding materials down against work tables. Other jaws are shaped as corner clamps, and some with flattened L-shaped ends for clamping angled work pieces. All these jaw configurations are limited in their clamping function by the way the jaw ends meet. The jaws open and close only, and are adjustable only within a limited range for gripping and holding work pieces. With prior art jaws, the work piece is held with the inside or inboard surface of the jaws.

There are prior art designs of non self-locking pliers which incorporate two handles acting as levers with work ends that spread their work pieces, but the jaws of these pliers do not work crossed and uncrossed, nor do they spread and hold with the compound lever force inherent in vise-grip style pliers. The ability to adjust and quickly release are convenience features, also absent in prior art.

Furthermore, the jaw designs of other vise-grip style pliers are unable to grasp hollow objects exclusively by the inside surface. Likewise they must grasp both the inside and outside surface simultaneously, which is inconvenient and undesirable in some applications. This engagement on both surfaces can cause damage, distortion or marring to the outside surface of work material.

The variety of specialized prior art jaw shapes including chain type locking pliers are designed to accommodate and facilitate application to numerous objects of various shapes and sizes however, all these jaw designs employ only an inward clamping force. One example of this limitation is in holding hollow work material, Prior art jaws must be re-positioned numerous times to accomplish certain tasks. This multiple re-positioning of the jaws increases the risk of bodily harm or disaster to those skilled in the trade. Likewise, it is very difficult to employ prior art pliers when re-opening a pinched end of a tail pipe on a vehicle.

OBJECTS AND ADVANTAGES

Accordingly, several objects and advantages of my invention have overcome many limitations of application presented by other locking plier clamps due to the shape and range of motion of their jaws. It is the general objective of my invention to provide an improved jaw shape and motion which allows a large variety of new applications for quick-releasable locking pliers not hitherto discovered.

My new jaw design does, and can in the future, employ state of the art actuating levers, adjustment, locking, and release contrivances of prior art in conjunction with an improved, originative split jaw to hold, close, spread, open and lift work pieces.

The purpose of this invention is to provide a jaw with an innovative shape and range of motion to add unique features of convenience, reach and sweep. The crossing and bypass function of my plier jaws can clamp and hold work pieces on the outside surfaces of the jaw ends, within hollow objects. However this plier still retains the conventional applications of prior art in that they can hold work pieces on the inside surfaces of the jaw ends also. The improved plier jaw anticipates a configuration to hold and lock in a spreading motion as well.

In one embodiment of this invention, a double or split fixed jaw permits a movable jaw to pass between or through it, providing a more positive and stable grip than prior art. An embodiment shown in the drawings can reach into work spaces conventional C-clamp-types of self-locking pliers cannot, and can grip curved surfaces, such as hollow work pieces, much better than prior art.

My modified jaws enable an engagement within objects such as pipe, square or rectangular tubing to facilitate holding hollow objects on the inside surface only. This type of engagement minimizes undesirable marring or damage to work material.

Varied tasks that require an application of outward or spreading force are facilitated and accommodated by my invention's jaws and future modifications of the crossing jaws.

For example these pliers can be employed to reshape a flattened exhaust tail pipe back to original form both quickly and efficiently. My jaws can be employed temporarily to space or position exhaust pipes away from the undercarriage of a vehicle, prior to welding or clamping. This technique will prevent rattles and provide normal clearance between parts. An operator can reach inside of a broken or cut exhaust pipe inside of a muffler and apply a clamping or spreading force to loosen or dislodge the piece.

From the inside an operator can grab or twist a suitable work-piece. The operator can use this plier to hold short, hollow or awkward objects, such as thermostat housings; pieces of pipe that need buffing or grinding, by the inside surface only. This method of engagement minimizes danger of slipping or snagging a work-piece, such as during a bench grinding operation. Employing this method, re-positioning the plier is unnecessary since the whole outside surface is always exposed, rendering the procedure much safer than other known methods.

Further objects and advantages of my invention will become apparent from a consideration of the drawings and ensuing description.

DESCRIPTION OF DRAWINGS

The foregoing and various other objects and features of this invention will be apparent and fully understandable from the following detailed description of a typical preferred form.

The drawing.

Figure 1:
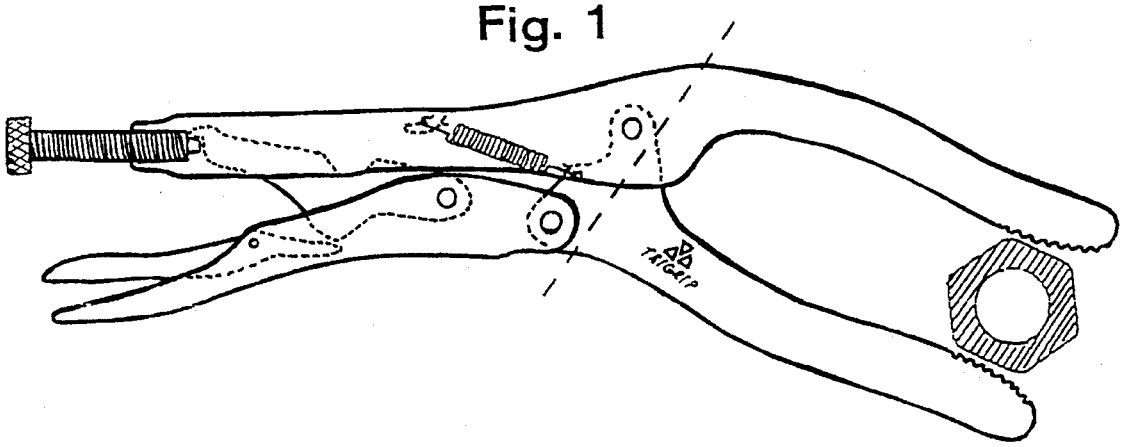
Prior Art Fig. 1
FIG. 1 is a side view of my jaw invention and prior art, self-locking pliers with the novel jaws mounted to it and locked in a position to hold the work material with the inside or inboard surfaces of the jaws.
Figure 2:
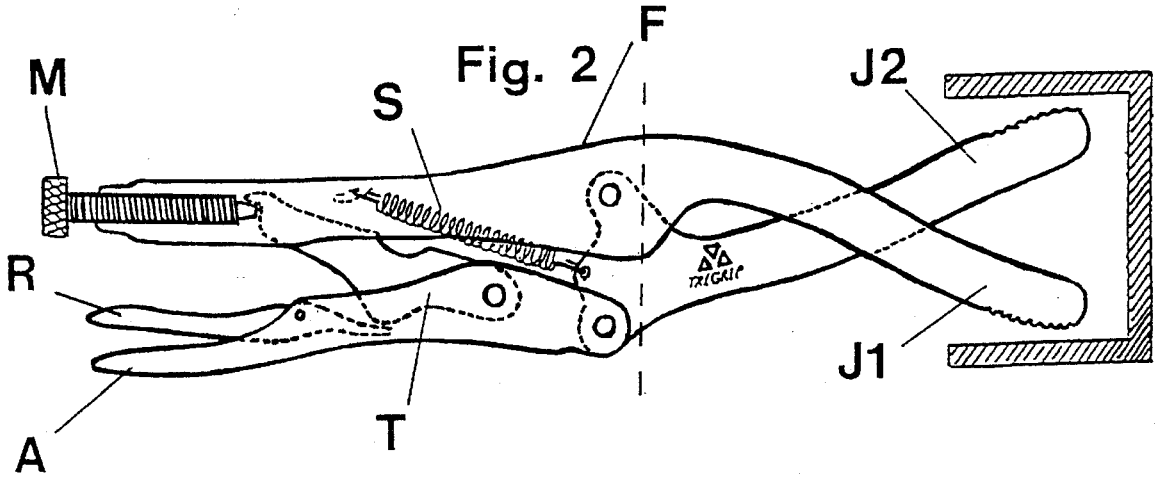
FIG. 2 is a side view of my jaw invention and prior art self-locking pliers with the new jaws engaged inside of a work-piece in a crossed position to hold, spread or lift a work piece on the outside or outboard surfaces of the jaws as in FIG. 1 above (same jaws).
Figure 3:
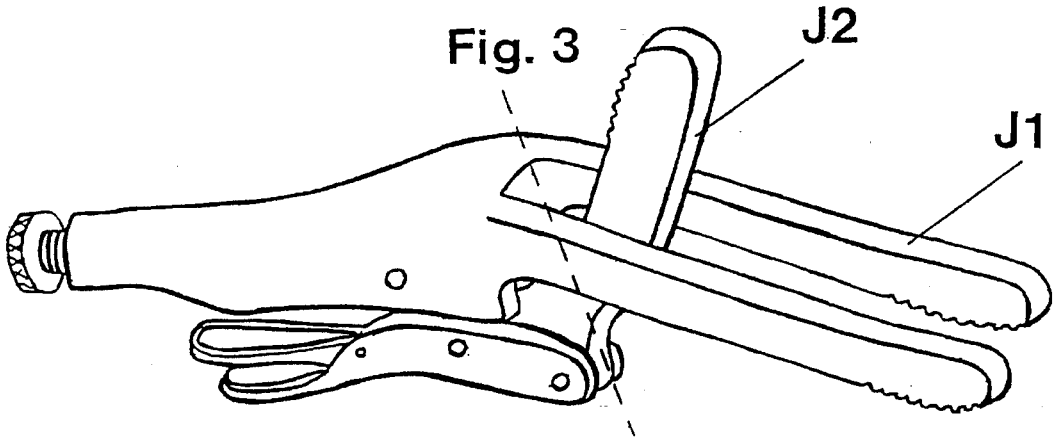
FIG. 3 is a perspective view of self-locking pliers showing an embodiment of the pliers with my added novel jaws, allowing the lower jaw to pass between the split upper jaws.

DESCRIPTION—FIGS. 1 to 3

Referring now to the drawings, this vise-grip type plier is a screw-adjustable, or other means adjustable, clamp or spreader mechanism with a quick release lever. A feature of its attachment to the work piece is that the jaws are releasably engaged onto or into the work material. The characteristic feature of this plier is that my jaw means are shaped in a way that permits a wider range of motion and versatility of application than comparable locking plier clamps.

As shown in FIGS. 2 and 3, this clamp includes a frame [F] that carries a fixed double or split jaw [J1] and a second movable jaw [J2] pivoting in the frame by means of an actuating lever [A] operable through a toggle link [T], backed by an adjustment screw [M] to position the operable jaw [J2] with respect to the fixed jaw. A spring [S] holds toggle link in place in the released or open position, while release lever [R] acts to open the plier or to spread the actuating levers or handles from the clamped position. Frame [F] and attendant parts [A] [T] [S] [R] and [M] are of prior art and are included herein only as illustrations of possible embodiments of invention, [J1] and [J2].

Jaw [J1] and [J2] are elongated and curved in this embodiment, but may be fashioned in other shapes within the scope of this invention.

The jaw [J1] herein embodied consists of a double or split fixed jaw through which a movable jaw [J2] can bypass and oppositionally cross.

Jaws [J1] and [J2] are positioned in spaced opposition to each other by the frame and attendant parts herein mentioned, so as to be firm and rugged, and jaws are confined to the end portions of the lever arms as shown.

SUMMARY, RAMIFICATIONS, AND SCOPE

This invention advantageously utilizes elongated, opposing and crossing jaws to facilitate holding, spreading, or lifting a wide range of materials in ways not hitherto discovered for a tool of the self-locking plier style. It is versatile, quickly applicable, quickly releasable and compact. It is characterized by the coupling of newly designed jaws employing a crossing jaw principle to the leverage, locking, holding, and release functions of a prior art, vise-grip plier clamp. A spread-only jaw invention may vary as required. The jaw styles themselves may also vary, not shown here, in the form of tip arrangements and designs for specialized future applications.

From the foregoing, it will be apparent that I have provided a new and useful vise-grip style plier that is quickly releasable. The characteristic features of this plier are the novel crossing jaws.

Thus the reader will see that quick-releasable, crossing jaws, locking pliers of my invention provides a highly reliable, convenient and useful design, promoting safer, quicker and easier methods of applications. While this description contains many specificities, they should not be construed as limitations on the scope of the invention, but rather as an exemplification of one preferred embodiment thereof. Many other variations are possible.

Thus the scope of the invention should be determined by the appended claims and their legal equivalents, rather than by the examples given. Having described only the typical preferred form and application of my invention, I do not wish to be limited or restricted to the specific details herein set forth, but wish to reserve to myself any modifications or variations that my appear to those skilled in the art, as set forth within the limits of the following claims.

I claim:

1. In a quick release pliers having a first and second jaw with the second jaw connected to the first at one pivot and to a quick release mechanism at a second pivot, the quick release mechanism engaging a threaded member to adjust the position of the release mechanism, the improvement comprising:

the first jaw being bifurcated and the second jaw being a single member adapted to fit between the bifurcated first jaw, whereby upon movement of the threaded member, the position of the second pivot is moved forward with respect to the jaws, thus placing the second jaw between the bifurcated first jaw, to allow for internal engagement of a workpiece.

* * * * *